US005156241A

United States Patent [19]

Sugie et al.

[11] Patent Number: 5,156,241

[45] Date of Patent: Oct. 20, 1992

[54] METHOD OF AUTOMATICALLY BREAKING AND REMOVING A NEARLY DEPLETED LAP BOBBIN AND AN APPARATUS FOR CARRYING OUT THE SAME

[75] Inventors: Tosio Sugie, Ogaki; Yoji Yamada, Ichinomiya; Seiji Kobori, Ogaki; Takaomi Hotta; Yasuhiro Serizawa, both of Shimada, all of Japan

[73] Assignees: Kabushikikaisha Hara Shokki Seisakusho, Ibi; Nisshinbo Industries,Inc., both of Tokyo, Japan

[21] Appl. No.: 476,498

[22] PCT Filed: Oct. 4, 1989

[86] PCT No.: PCT/JP89/01017

§ 371 Date: Jun. 8, 1990

§ 102(e) Date: Jun. 8, 1990

[51] Int. Cl.[5] ..... B65H 35/00

[52] U.S. Cl. ..... 242/55; 225/4

[58] Field of Search ..... 242/55, 55.1, 58, 58.6, 242/68.7, 54 R; 19/115 A, 115 R, 215; 28/192, 193; 225/4

[56] References Cited

U.S. PATENT DOCUMENTS

| | | | |
|---|---|---|---|
| 3,582,010 | 6/1971 | Whiteman | 242/68.7 X |
| 4,892,610 | 1/1990 | Sano | 242/58.6 X |
| 4,996,747 | 3/1991 | Wichtermann et al. | 19/115 R |

*Primary Examiner*—Daniel P. Stodola
*Assistant Examiner*—John P. Darling
*Attorney, Agent, or Firm*—Burns, Doane, Swecker & Mathis

[57] ABSTRACT

A method of automatically breaking and removing a nearly depleted lap (3), comprising steps of moving down the nearly depleted lap (3) held at the opposite ends thereof by a lap holding device (7) through the increased gap between the pair of lap rollers (5, 6) of a lap feeder (1), breaking the lap sheet (4) by applying a tension thereto, releasing the hold of the nearly depleted lap (3) to drop the nearly depleted lap (3) onto a conveying device (9), and carrying out the nearly depleted lap (3) by the conveying device (9), and an apparatus thereof.

4 Claims, 3 Drawing Sheets

METHOD OF AUTOMATICALLY BREAKING AND REMOVING A NEARLY DEPLETED LAP BOBBIN AND AN APPARATUS FOR CARRYING OUT THE SAME

TECHNICAL FIELD

The present invention relates to a method of automatically breaking and removing a nearly depleted lap bobbin when a lap bobbin in use becomes a nearly depleted lap bobbin in a textile machine for processing laps which are supplied successively thereto, and an apparatus for carrying out such a method. The textile machine in this application denotes mainly a ribbon lap machine and a comber.

PRIOR ART

Where a ribbon lap machine is used as the textile machine, when the lap supplied to the ribbon lap machine is completely depleted, a sensor is activated and the machine is stopped. In a conventional case, the operator interrupts the present work upon the recognition of the lit pilot lamp and goes to the relevant ribbon lap machine or goes to the relevant textile machine after completing the present work, and then the operator breaks and removes an end portion of the residual lap extending over the plate, by hand, removes an empty bobbin, supplies a full lap bobbin to the lap feeder of the textile machine, and superposes the leading end of the lap sheet of the full lap on the trailing end of the preceding lap sheet.

Since such a textile machine has six or eight delivery units, the textile machine remains inoperative for a long time while the lap changing operation is performed six or eight times and, in some cases, the textile machine remains inoperative for still a longer time in case the lap changing operation, which requires skilled work must be performed over again. Accordingly, an efficiency of operation of the conventional textile machine of the foregoing type is very low.

Apparatus intended for automatically carrying out those steps of the lap changing operation have been proposed, to solve the above-mentioned problems. However, all those previously proposed apparatus are large in size, are obstructive to cleaning and maintenance work, and are unsatisfactory Thus, a practically satisfactory apparatus for automatic lap changing operation has not been proposed.

DISCLOSURE OF THE INVENTION

An object of the present invention is to provide a novel method of automatically breaking and removing a nearly depleted lap bobbin, heretofore impossible, and an apparatus for automatically breaking and removing the nearly depleted lap bobbin and used for carrying out such a method.

The object of the invention can be attained by a method for automatically breaking and removing a nearly depleted lap bobbin, characterized in that the method comprises steps of: holding the nearly depleted lap bobbin supported on a pair of lap rollers of a lap feeder of the textile machine at the opposite ends of the nearly depleted lap bobbin after the textile machine has been stopped; moving down the nearly depleted lap bobbin through the gap between the pair of lap rollers while the gap between the pair of lap roller is being increased or after the gap between the pair of lap rollers has been increased to a size allowing the nearly depleted lap bobbin to pass through the gap; breaking a lap sheet of the nearly depleted lap bobbin at an upstream position from the lap processing mechanism arranged on a downstream position from the lap feeder in the textile machine by stretching the lap sheet continuing to the nearly depleted lap bobbin by the movement of the nearly depleted lap bobbin; and releasing the hold of the nearly depleted lap bobbin to drop the nearly depleted lap bobbin onto a conveying device to carry out the nearly depleted lap bobbin.

An automatic nearly depleted lap bobbin breaking and removing apparatus suitable for carrying out the method for automatically breaking and removing a nearly depleted lap bobbin is characterized in that the apparatus is comprised of a lap holding device capable of holding the nearly depleted lap bobbin supported on front and back lap rollers of a lap feeder at the opposite ends of the bobbin thereof and capable of turning around the front lap rollers; a support shaft supporting the back lap roller and capable of moving the back lap roller away from the front lap roller; and a conveying device for receiving the nearly depleted lap bobbin dropped thereon and conveying the nearly depleted lap bobbin in an axial direction of the lap feeder.

Preferably, the lap holding device comprises: a pair of arms pivotally supported on the shaft of the front lap roller of the lap feeder and extending toward the back lap roller; a pair of lap holding members for holding the nearly depleted lap bobbin, supported on the pair of arms respectively at positions near the extremities of the arms, and spaced apart in parallel from each other with respect to the axial direction of the lap rollers of the lap feeder; and a gripping mechanism capable of moving along a curved path so as to project between the pair of lap holding members and capable of holding the bobbin of the nearly depleted lap bobbin at the opposite ends thereof.

More preferably, the apparatus is provided with a lap receiver kinematically interlocked with the support shaft so as to be caused to swing by the support shaft between a substantially horizontal position under the lap feeder and a substantially vertical position. It is still more preferable that the lap receiver is comprised of a plate having one end connected to a shaft interlocked with the support shaft by a gear train which increases the angle of rotation of the support shaft.

BEST MODE FOR CARRYING OUT THE INVENTION

The present invention will be described in detail with reference to the accompanied drawings illustrating a preferable example of an apparatus for carrying out a method of automatically breaking and removing a nearly depleted lap bobbin in accordance with the present invention.

Figure 1:
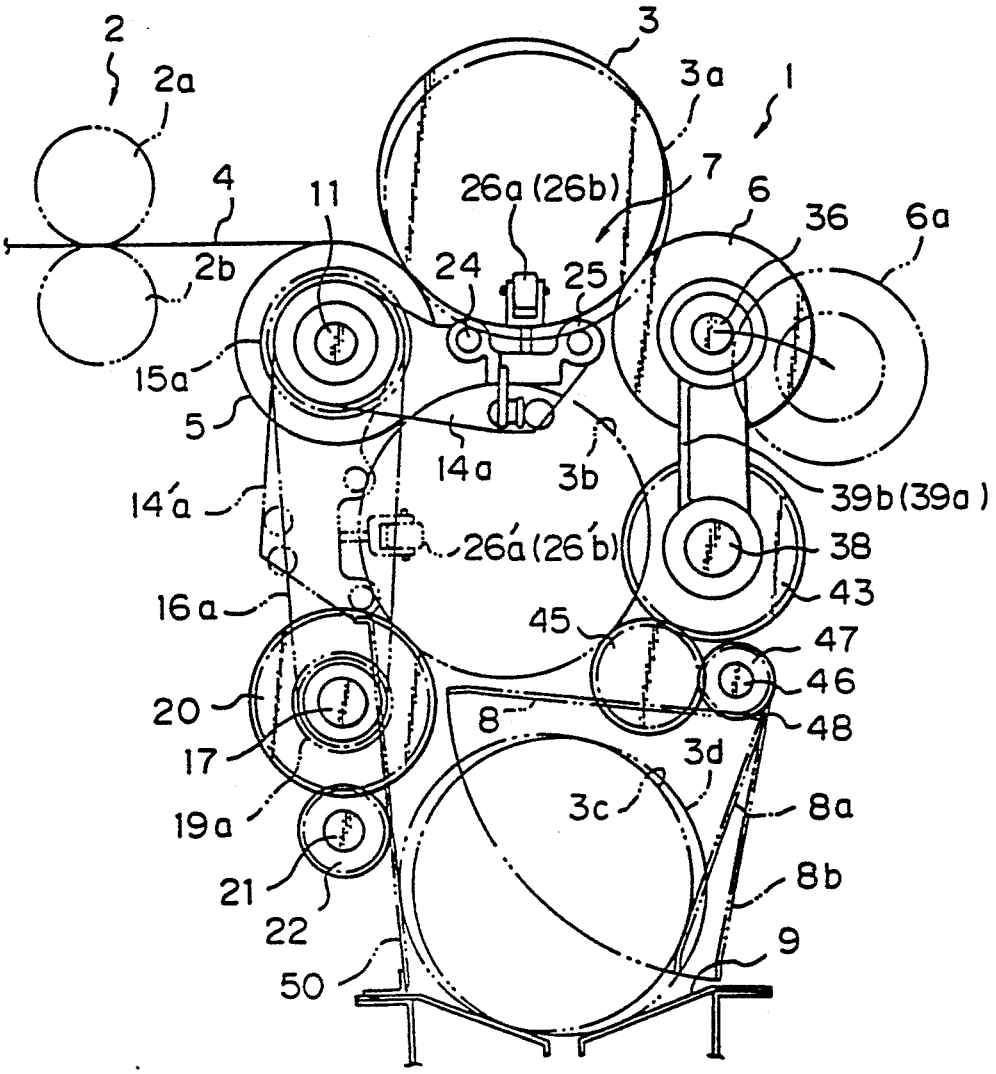
FIG. 1 is a side elevation of an automatic nearly depleted lap bobbin breaking and removing apparatus in a preferred embodiment according to the present invention.

FIG. 1 is a side elevation view of the automatic nearly depleted lap bobbin breaking and removing apparatus in accordance with the present invention, incorporated into a ribbon lap machine.

In FIG. 1, reference numeral 1 denotes a lap feeder composed of a pair of feeding roller, i.e., lap rollers 5, 6. A lap sheet 4 is unwound from a lap bobbin 3 mounted on the pair of the lap rollers 5, 6 and is fed to a lap sheet processing mechanism 2, i.e., in this case to a pair of nip rollers 2*a* and 2*b*, to apply a drafting action thereto.

The lap sheet 4 is unwound from the lap 3 and fed to the lap sheet processing mechanism by the synchronous rotation of the lap roller 5 and 6 until a lap bobbin becomes a nearly depleted lap bobbin. When the lap bobbin is nearly depleted, a nearly depleted lap bobbin breaking and removing apparatus (hereafter referred to as a bobbin removing apparatus) in accordance with the present invention is actuated.

The bobbin removing apparatus in accordance with the present invention has a lap holding device 7 pivotally supported on a support shaft 11 supporting one of the lap rollers of the lap feeder on the side of the lap sheet processing mechanism 2, namely, the front lap roller 5. The lap holding device 7 has a pair of holding rollers 26*a* and 26*b* for holding the nearly depleted lap 3 at the opposite ends of the bobbin thereof. Accordingly, the nearly depleted lap bobbin 3 held by the lap holding device 7 can be revolved down about a support shaft 11 of the front lap roller 5. At that time, the lap sheet 4 is broken between the front lap roller 5 and the nip roller 2*a* and 2*b* of the lap sheet processing mechanism 2.

A width of a gap between the front lap roller 5 and the back lap roller 6 of the lap feeder must be increased to a width allowing the nearly depleted lap bobbin 3 to pass the gap, before moving the nearly depleted lap bobbin 3 downward. In the embodiment shown in FIG. 1, a plurality of back lap roller support shaft support arms (hereinafter, referred to as "back support arms") 39*a*, 39*b* and 39*c* are arranged under the back lap roller 6 to support the support shaft 36 supporting the back lap roller 6. The back support arms 39*a*, 39*b* and 39*c* moves the back lap roller 6 around a back lap roller swinging shaft (hereinafter, referred to as "back swinging shaft") 38 extended in parallel to the support shaft 36 to a position 6*a* indicated by a broken line in FIG. 1.

Thus the nearly depleted lap bobbin 3 is moved from a position 3*a* to a position 3*b* as indicated by alternate long and two short dashes lines in FIG. 1. As shown in FIG. 1, when the holding rollers 26*a* and 26*b* at positions 26'*a* and 26'*b* holding the bobbin of the nearly depleted lap bobbin 3 at a position 3*b* at the opposite ends of the bobbin release their hold of the bobbin, the nearly depleted lap bobbin 3 drops by gravity from the position 3*b* onto a conveying device 9 disposed under the position 3*b*. Then, the conveyor, not shown, of the conveying device 9 conveys the nearly depleted lap bobbin 3 to one end of the textile machine.

When the height of the holding rollers from the conveying device is large and the nearly depleted lap bobbin 3 drops directly onto the conveying device 9 after being released at the position 3*b* from the holding rollers 26*a* and 26*b* at the positions 26'*a* and 26'*b*, problems, such as damaging the bobbin and generation of noise, arise. A lap receiver 8 having the shape of a plate is provided to receive the nearly depleted lap bobbin 3 released at the position 3*b*. The lap receiver 8 can swing from a position indicated at 8 to positions 8*a* and 8*b* indicated by alternate long and two short dashes lines in FIG. 1 synchronously with the turning motion of the support shaft to place the nearly depleted lap on the conveying device 9 without damaging the bobbin.

Figure 2:
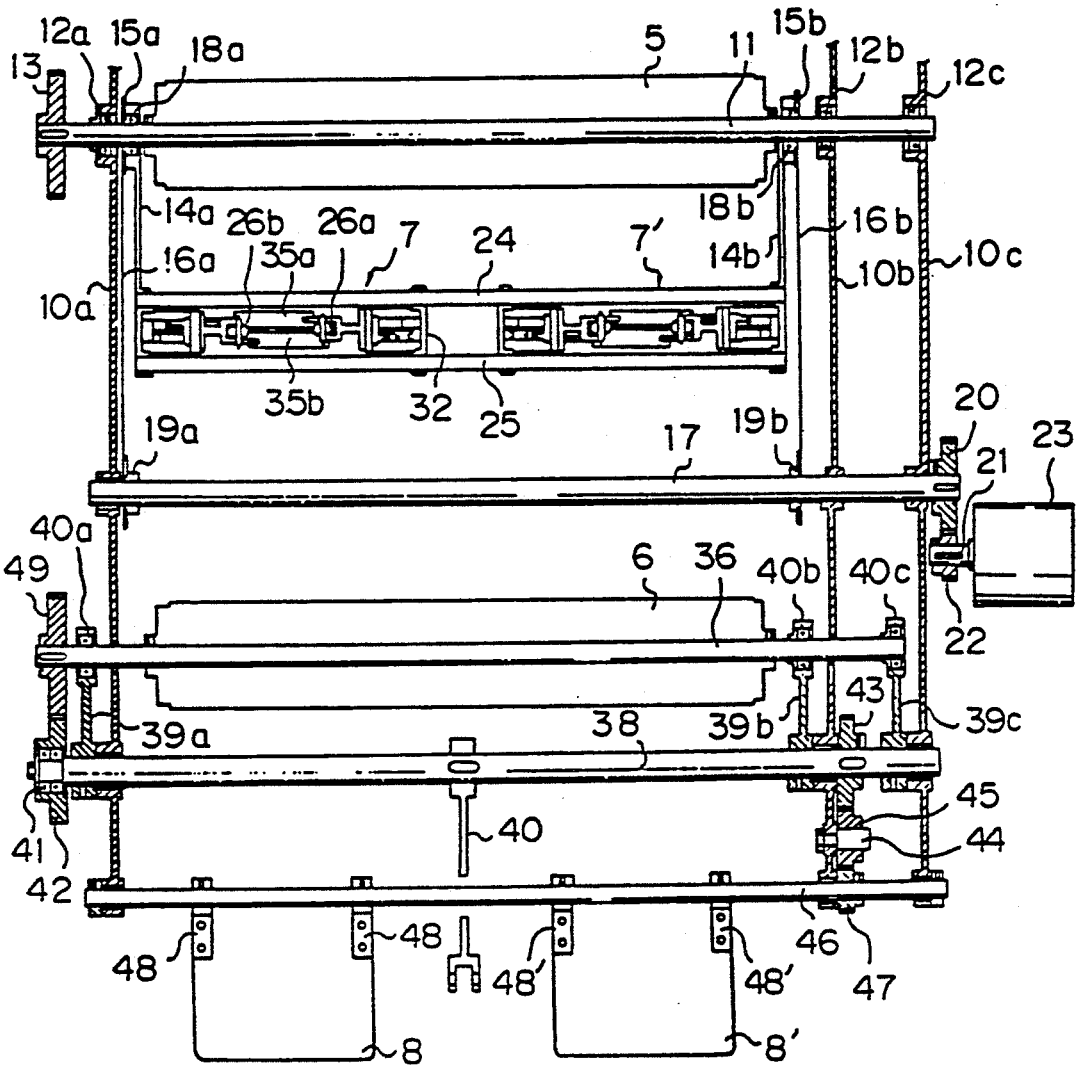
FIG. 2 is a front elevation of a driving mechanism included in the apparatus shown in FIG. 1.
Figure 3A:
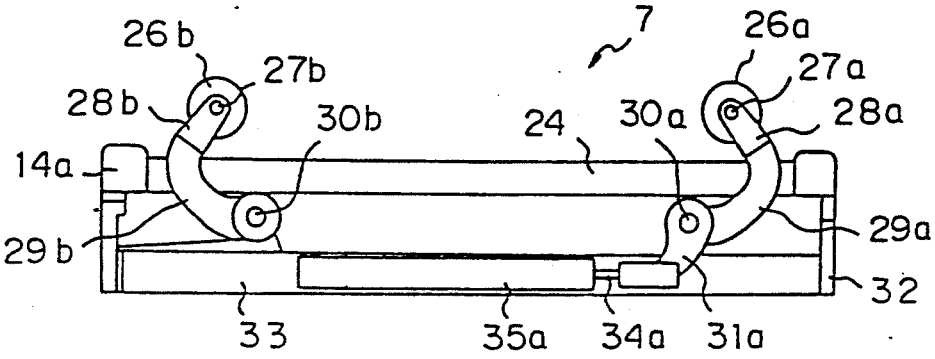
FIG. 3(A) is a front elevation of a lap holding device having holding collars in an open position included in the apparatus shown in FIG. 1.
Figure 3B:
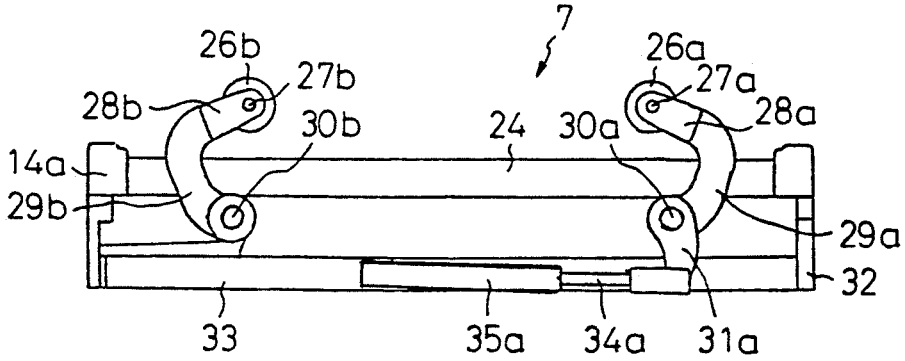
FIG. 3(B) is a front elevation of a lap holding device having holding rollers in a closed position in the apparatus shown in FIG. 1.

The automatic bobbin removing apparatus in accordance with the present invention will be described hereinafter with reference to FIG. 2 showing a driving mechanism for driving the mechanisms of the automatic bobbin removing apparatus shown in FIG. 1, and FIG. 3 showing the details of an essential portion of the lap holding device 7.

In FIG. 2, numerals 10*a*, 10*b* and 10*c* denote frames of the ribbon lap machine and FIG. 2 shows an example in which each lap roller 5.6 supports two lap bobbins. Accordingly, two lap holding devices 7 and 7', and two lap receivers 8 and 8' are shown in FIG. 2.

In FIG. 2, the support shaft 11 supporting the front lap roller 5 is supported for rotation in bearings 12*a*, 12*b* and 12*c* on the frames 10*a*, 10*b* and 10*c*. A driving bear 13 is fixed to one end of the support shaft 11 to rotate the front lap roller 5 in a given mode of rotation. A pair of lap holding device supports arms 14*a* and 14*b* are supported each at one end thereof for swing motion together with sprockets 15*a* and 15*b* fixed to the support shaft 11 in bearings 18*a* and 18*b* on the support shaft 11 respectively on the opposite sides of the front lap roller 5. A lap holding device swinging shaft 17 is extended in parallel to the support shaft 11 supporting the front lap roller 5 and is supported rotatably on the frame 10*a*, 10*b* and 10*c*. As shown in FIG. 2, sprockets 19*a* and 19*b* are fixed to the lap holding device swinging shaft 17, and chains 16*a* and 16*b* are extended between the sprockets 15*a* and 19*a* and between the sprockets 15*b* and 19*b* fixed on the support shaft 11, respectively. A gear 22 mounted on the output shaft 21 of a motor 23 engage a gear 20 fixed to one end of the lap holding device swinging shaft 17. The motor 23 is actuated to drive the lap holding device support arms 14*a* and 14*b* for swing motion on the support shaft 11 through the lap holding device swinging shaft 17 and the chains 16*a* and 16*b*, whereby the lap holding device 7 is moved to and from a position 14'*a* indicated by an alternate long and two short dashes line in FIG. 1.

In the bobbin holding device shown in FIG. 2, the two lap holding devices 7 and 7' are disposed between the pair of two lap holding device supporting arms 14*a* and 14*b*.

As shown in FIG. 2, the two lap holding devices 7 and 7' are disposed between the two lap holding device support arms 14*a* and 14*b*. The two lap holding devices 7 and 7' are substantially the same, only the lap holding device 7 on the left-hand side in FIG. 2 will be described. The lap holding device 7 has two lap support bars 24 and 25 extended in parallel to the front lap roller 5. The opposite ends of each of the lap support bars 24 and 25 are fixed to the lap holding device support arms 14*a* and 24*b*. The lap holding device 7 has a pair of holding rollers 26*a* and 26*b* for holding the bobbin of the lap bobbin 3 at the opposite ends thereof, respectively. The holding rollers 26*a* and 26*b* are supported rotatably through the pins 27*a* and 27*b* on a bifurcated support arms 28*a* and 28*b*, respectively. Upper support bars 29*a* and 29*b* joined integrally to the lower end of the support arms 28*a* and 28*b* are supported pivotally on pins 30*a* and 30*b* fixed to the side wall, now shown, of the lap holding device 7. A pneumatic cylinder 35*a* is fixed to a lower member of the lap holding device 7. A lower support bar 31*a* is fixed to the extremity of a piston 34*a* moved slidably by supplying air into the pneumatic cylinder 35*a*. Lower support bars 31*a* are supported pivotally at the upper end thereof on pins 30*a* and 30*b* and fixed to upper support bars 29*a* and 29*b*, respectively. When the pneumatic cylinder actuators 35*a* and 35*b* (the pneumatic cylinder actuator 35*b* is disposed on the backside of FIG. 3 and hence is not shown) are actuated, the upper support bars 29*a* and 29*b* are turned on the pins 30*a* and 30*b* to enable the holding rollers 26*a* and 26*b* to move between an open position shown in FIG. 3(A) at which the holding rollers 26*a* and 26*b* are spaced apart at a relatively large distance and a closed position shown in FIG. 3(B) at which the holding rollers 26*a* and 26*b* are spaced apart at a relatively small distance to hold and turn downward the lap bobbin supported on the lap support bars 24 and 25 at the opposite ends of its bobbin.

A mechanism for swinging the back lap roller 6 and the lap receiver 8 will be described hereinafter. The back swinging shaft 38 is extended in parallel to the back lap roller 6 and is journaled on the frames 10*a*, 10*b* and 10*c*. As shown in FIG. 2, back support arms 39*a*, 39*b* and 39*c* are fixed to the back swining shaft 38. The support shaft 36 supporting the back lap roller 6 is supported in bearings 40*a*, 40*b* and 40*c* provided respectively on the extremities of the back support arms 39*a*, 39*b* and 39*c*. As shown in FIG. 2, a gear 42 is supported on a bearing 41 attached to one end of the back swinging shaft 38, and a gear 43 engaging the gear 42 is fixed to one end of the support shaft 36. Thus, the back swinging shaft 38 is turned to move the back lap roller 6 around the back swining shaft 38 by the back support arms 39*a*, 39*b* and 39*c* between a position 6 indicated by a continuous line and a position 6*a* shown in FIG. 1. While the ribbon lap machine is in the normal operation, the gear 42 is driven for rotation by a driving device, not shown, to rotate the back lap roller 6 through the gear 49. The rotation of the gear 42 is transmitted through a rotative interlocking mechanism, not shown, to the gear 13 fixed to the front lap roller 5 to rotate the front lap roller and the back lap roller synchronously.

A swing motion of the back lap roller is applied by a driving rod 40 having one end fixedly joined to the back swinging shaft 38 and the other end connected to a pneumatic cylinder, not shown.

As shown in FIG. 2, the two lap receivers 8 and 8' having the shape of a plate are fixed to brackets 48 and 48' fixed to a lap receiver support shaft 46 extended in parallel to the back lap roller 6. The lap receiver support shaft 46 is journaled on the frame 10*a*, 10*b* and 10*c*. As shown in FIG. 2, a gear 47 fixed to the lap receiver support shaft 46 engages an intermediate gear 45 engaging the gear 43 fixed to the back swinging shaft 38. The shaft 44 of the intermediate gear 45 is supported on the frame 10*b*. Preferably, the gear ratio of the gear train consisting of the gears 43, 45 and 47 is determined so as to increase the angle of rotation of the back swinging shaft 38 in transmitting the rotation of the back swinging shaft 38 to the lap receiver support shaft 46 because, as is obvious from FIG. 1, the swing motion of the back lap roller 6 through a very small angle causes the lap receiver 8 to swing through a large angle on the order of 90 degrees. Preferably, a guide 50 is provided on the front side as shown in FIG. 1 to guide the lap.

Although the apparatus shown in FIG. 2 is provided with the three frames 10*a*, 10*b* and 10*c* and the three back support arms 39*a*, 39*b* and 39*c*, the frame 10*c* and the back support arm 39*c* are provided only for reinforcement, and hence the frame 10*c* and the back support arm 39*c* need not necessarily be provided.

As stated above, the automatic bobbin removing apparatus of the present invention employs three kinds of driving devices, namely, the motor 23 for swinging the lap holding device 7, the pneumatic cylinder 35*a* and 35*b* for operating the pair of holding rollers 26*a* and 26*b* of the lap holding device 7, and the pneumatic cylinder actuator, not shown, for rotating the back swinging shaft 38. These three kinds of driving devices are controlled for a series of sequential operations by a sequencer. Therefore, when desired, sensors for detecting the positions of the component members may be provided.

The operation of the automatic bobbin removing apparatus of the present invention will be described hereinafter.

Upon the depletion of the lap supported on the lap rollers 5 and 6 to a certain extent, the textile machine, for example, the ribbon lap machine, is stopped. Subsequently, the lap holding device 7 is turned upward around the support shaft 11 along a circular path through the gap between the lap rollers 5 and 6. The back lap roller 6 starts moving to the position 6*a* (FIG. 1) immediately before the lap support bars 24 and 25 of the lap holding device 7 come into contact with the nearly depleted lap bobbin 3 supported on the lap rollers 5 and 6. Consequently, the nearly depleted lap bobbin 3 is lowered slightly to the position 3*a*, where the nearly depleted lap bobbin 3 is supported on the lap support bars 24 and 25. Then, the holding rollers 26*a* and 26*b* of the lap holding device 7 approach the opposite ends of the bobbin of the nearly depleted lap 3 to hold the nearly depleted lap bobbin 3 at the opposite ends of the bobbin at the position 3*a*. Then, the lap holding device 7 is turned downward around the support shaft 11, whereby the lap sheet 4 extending from the nearly depleted lap bobbin 3 at the position 3*a* to the lap sheet processing mechanism 2 is broken. In most cases, the lap sheet 4 is broken at a position between the front lap roller 5 and the back rollers 2*a* and 2*b* of the lap sheet processing mechanism 2. The lap holding device 7 releases the hold of the nearly depleted lap bobbin 3 at the position 3*a* (FIG. 1) to drop the nearly depleted lap bobbin 3 onto the lap receiver 8. Then, the lap receiver 8 moves through a position 8*a* to a position 8*b* while the nearly depleted lap bobbin 3 is guided by the guide 50 through positions 3*c* and 3*d* to the conveyor of the conveying device 9. Then, the conveyor carries out the nearly depleted lap bobbin 3 from the textile machine. The back lap roller 6 is returned to the original position in synchronism with the circular swing motion of the lap receiver 8. Finally, a full lap, which has been held behind the back lap roller 6, is supplied onto the lap rollers 5 and 6 disposed with a given gap therebetween to complete the automatic nearly depleted lap bobbin breaking and removing operation.

CAPABILITY OF EXPLOITATION IN INDUSTRY

The automatic lap removing method and the automatic bobbin removing apparatus thus constructed in accordance with the present invention have the following effects.

(1) Since the defective portion of a lap fleece (the leading end of the lap sheet in the preceding process)

can be removed, the quality of the fleece produced by the textile machine can be improved and unsuccessful lap sheet piecing operation is obviated.

(2) Since the automatic bobbin removing apparatus is disposed substantially under the essential portion of the textile machine, work for the maintenance and cleaning of the textile machine can easily and safely be performed, and, since the automatic bobbin removing apparatus is contained within the main frame of the textile machine, the automatic bobbin removing apparatus does not spoil the appearance of the textile machine.

(3) Since the lap holding device holding the lap pulls the lap sheet, the lap sheet can surely be broken.

(4) Since the automatic bobbin removing apparatus is compact and is designed for installation under the essential portion of the textile machine, an automatic lap piecing apparatus can easily be incorporated into the textile machine.

We claim:

1. A method of automatically breaking and removing a nearly depleted lap bobbin when a lap bobbin in use becomes nearly depleted in a textile machine for processing laps which are supplied successively thereto, characterized in that said method comprises steps of: holding the nearly depleted lap bobbin supported on a pair of lap rollers of a lap feeder of the textile machine at the opposite ends of the nearly depleted lap bobbin after the textile machine has been stopped; moving down the nearly depleted lap bobbin through the gap between the pair of lap rollers while the gap between the pair of lap rollers is being increased or after the gap between the pair of lap rollers has been increased to a size allowing the nearly depleted lap bobbin to pass through the gap; breaking a lap sheet of the nearly depleted lap bobbin at a position upstream of a lap processing mechanism arranged at a position downstream of the lap feeder in the textile machine by stretching the lap sheet withdrawn from the nearly depleted lap bobbin by the movement of the nearly depleted lap bobbin; and releasing the hold of the nearly depleted lap bobbin to drop the nearly depleted lap bobbin onto a conveying device to remove the nearly depleted lap bobbin from the lap feeder.

2. An automatic lap sheet breaking and removing apparatus used in a lap treating textile machine composed of a lap feeder having a pair of lap rollers for supporting a lap bobbin thereon and feeding a lap sheet unwound from the lap bobbin, and a lap bobbin processing mechanism disposed at a position downstream of the lap feeder; characterized in that said apparatus is comprised of a lap holding device supported for turning motion around a front lap roller of the lap feeder on the side of the lap processing mechanism and capable of holding a nearly depleted lap bobbin at the opposite ends of the bobbin thereof; said lap holding device including a pair of arms pivotally supported on the shaft of the front lap roller of the lap feeder and extending toward a back lap roller; a pair of lap holding members for holding the nearly depleted lap bobbin supported on the pair of arms respectively at positions near the extremities of the arms, and spaced a part from and in parallel with each other with respect to the axial direction of the lap rollers of the lap feeder; and a gripping mechanism capable of moving along a curved path so as to project between the air of lap holding members and capable of holding the bobbin of the nearly depleted lap bobbin at the opposite ends thereof; a support shaft supporting the back lap roller of the lap feeder and capable of moving the back lap roller away from the front lap roller to thereby increase a gap to a size allowing the nearly depleted lap bobbin to pass through said gap between the front lap roller and the back lap roller, whereby the lap sheet is broken by a stretching operation applied by a self-weight of the nearly depleted lap bobbin; and a conveying device for receiving the nearly depleted lap bobbin dropped from the gap thereon and conveying the nearly depleted lap bobbin in an axial direction of the lap feeder.

3. An apparatus according to claim 2, wherein a lap receiver connected with the support shaft so as to be caused to swing by the support shaft between a substantially horizontal position under the lap feeder and a substantially vertical position is provided.

4. An apparatus according to claim 2, wherein said lap receiver is comprised of a plate having one end connected to a shaft interlocked with the support shaft by a gear train which increases the angle of rotation of the support shaft.

* * * * *